US006619014B2

(12) United States Patent
Muller

(10) Patent No.: US 6,619,014 B2
(45) Date of Patent: Sep. 16, 2003

(54) METHOD AND DEVICE FOR THE STRAPPING OF STACKS OF PRINTED PRODUCTS

(75) Inventor: Erwin Muller, Durnten (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/942,346

(22) Filed: Aug. 29, 2001

(65) Prior Publication Data

US 2002/0073651 A1 Jun. 20, 2002

(30) Foreign Application Priority Data

Aug. 30, 2000 (CH) ..... 1687/00

(51) Int. Cl.[7] ..... B65B 13/02

(52) U.S. Cl. ..... 53/399; 53/414; 53/447; 53/147; 53/540; 53/541; 53/588; 53/589; 53/449

(58) Field of Search ..... 53/414, 447, 147, 53/540, 541, 588, 589, 449, 399; 493/204

(56) References Cited

U.S. PATENT DOCUMENTS 3,914,918 A * 10/1975 Laird ..... 206/83.5
3,994,118 A * 11/1976 Felix ..... 100/15
4,406,728 A * 9/1983 Ohba et al. ..... 100/27
4,712,354 A * 12/1987 Lancaster et al. ..... 53/176
4,828,645 A * 5/1989 Van Bortel ..... 156/216
4,870,807 A * 10/1989 Palamides et al. ..... 53/528
5,126,002 A * 6/1992 Iwata et al. ..... 156/468
5,299,410 A * 4/1994 Freeman ..... 53/442
5,577,371 A * 11/1996 Lang et al. ..... 100/30
6,003,438 A * 12/1999 Schwede ..... 100/26
6,027,298 A * 2/2000 Crowley ..... 414/373
RE36,687 E * 5/2000 Marschke et al. ..... 68/22 R

* cited by examiner

*Primary Examiner*—Eugene Kim
*Assistant Examiner*—Brian D Nash
(74) *Attorney, Agent, or Firm*—Rankin, Hill, Porter & Clark LLP

(57) ABSTRACT

For sequentially strapping stacks of printed products (3) with a strapping tape (27), stacks are conveyed to a strapping position pressed together between two presser arms (8.1 and 8.2.) and are there strapped in a pressed-together condition. A loop of the strapping tape (27) positioned around the stack (3) is tightened, locked and cut-off from a supply roll. In doing so, the tape loop is applied in a zone of the stack face sides outside the presser arms (8.1 and 8.2.) and aligned with slot-shaped apertures (19.1, 19.2) in the presser arms (8.1 and 8.2.) such that the strapping tape (27), when it is being tightened, is moved through the apertures (19.1, 19.2) and comes to lie directly on the face sides of the stack. The strapping is advantageous to strap stacks (3), which have either been previously, or are being simultaneously, enveloped with an enveloping material (25), whereby the envelope is applied around the stack (3) and the presser arms (8.1 and 8.2.), and the strapping is applied outside of the envelope.

12 Claims, 7 Drawing Sheets

METHOD AND DEVICE FOR THE STRAPPING OF STACKS OF PRINTED PRODUCTS

The invention is situated in the field of packaging technology and concerns a method and a device in accordance with the generic terms of the corresponding independent claims. Method and device serve for the strapping of stacks of printed products. They are suitable in particular for being utilised with stacks of varying stack heights and for stacks of printed products with an edge, in the zone of which the product is thicker than in other zones, which reduces the stability of the stack as a result of its increased thickness. Printed products of this type are, e.g., folded newspapers or magazines with a bonded or stapled rear edge.

Printed products are laid out as an imbricated stream when coming from the rotary printing press or from a coil, but also from various other further processing devices (e.g., insert drums). For transportation and distribution, these printed products as a rule are stacked (in most cases in crossed stacks) and when so required the stacks are equipped with cover sheets and if necessary enveloped/wrapped and then strapped, so that they can be transported in a stable condition.

Devices for the strapping of stacks of printed products are known to the specialist, e.g., from the publication DE-3248788. These devices usually comprise a loop-shaped tape channel, means for the positioning of a strapping tape from a supply roll in the tape channel, means for the tightening and tensioning of the tape loop laid out in the tape channel around a stack positioned in the zone of the tape channel and means for locking the strapping around the stack and for cutting off the strapping tape locked around the stack from the supply roll. The tape channel is arranged and designed in such a manner, that it does not impair the feeding-in and the removal of the stack and in such a manner, that the strapping tape during tightening can be pulled out of the channel along its whole length without any problem.

The affixing of a strapping around a stack of printed products can be problematical, if the stack has not much stability and therefore is difficult to manipulate and has to be transported from a stacking shaft into a strapping position for the strapping operation, which is usually the case in known arrangements. In doing so, the stack has to be braked, strapped and accelerated again. Because the stack is relatively unstable, no great accelerations are possible, as a result of which the cycle time becomes relatively long.

In the publication WO-00/34127 a device is described, with which the problems mentioned above, which are caused by the instability of stacks, can be solved, in that the stacks are pushed out of the stacking shaft and immediately between two presser arms and are only released from the presser arms, when they have been enveloped/wrapped and as a result are stabilised at least to a limited extent. In doing so, the envelope is applied around the presser arms and the stacks are slid off the presser arms together with their envelopes/wrappings. Obviously an envelope of this type only leads to a stabilisation of the stack, if the enveloping material also after the withdrawing of the presser arms is still sufficiently tightly wrapped around the stack. This has the prerequisite, that the enveloping material is sufficiently elastic and can be sufficiently tensioned and/or that the stacked objects are sufficiently elastically compressible and can be pressed together sufficiently. If this is not the case, then the stack either before or after being enveloped has to be strapped in a separate operating step, whereby the same problems occur as are described above for either not—or insufficiently stabilised stacks.

The envelopment/wrapping in accordance with the publication mentioned above is implemented by moving the stack held pressed together by the presser arms against a curtain of enveloping material extending across its direction of conveyance, which curtain during the onward conveyance is placed around the preceding side of the stack and of the presser arms and on the trailing side of the stack can be closed to form a closed-in-itself envelope/wrapping. The enveloping material is simultaneously cut in such a manner, that it once again forms a curtin for a following stack.

It now is the objective of the invention to create a method and a device for the strapping of stacks of printed products, by means of which in particular relatively unstable and if so required already enveloped stacks can be strapped in a simple manner. The method and the device are to make as few as possible demands of the stack and of the strapping tape and in addition are to be adaptable without any problems for the strapping of stacks with differing stack heights.

This objective is achieved by the method and by the device as they are defined in the claims.

The invention in essence is based on the fact, that the stack held pressed between two presser arms is conducted to a strapping position in such a manner, as it is essentially described in the publication WO-00/34127 already mentioned above. The stacks are completely strapped with a strapping tape while the stack is held pressed together by the presser arms. In order, however, that the strapping is not subject to the same limiting conditions as the envelopment/wrapping in accordance with the publication mentioned, while the tape loop necessary for the strapping in the zone of the face sides of the stack is applied around the presser arms, whereby, however, in each of the two presser arms respectively a slot-like aperture is provided, to which the tape loop is aligned and through which the strapping tape is pulled during the tightening of the loop, in order for it to be able to be positioned directly on the stack also on the face sides of the stack.

The slot-like apertures of the two presser arms are aligned to one another and have two closed ends or a closed and an open end. They are designed in such a manner, that the closed ends rise above a stack held between the presser arms in such a way, that the strapping tape for the application of the tape loop can be led through the apertures from the zone between the presser arms next to the stack onto the outside of the presser arms and back again.

For the establishment of the tape loop, tape guides (e.g., a tape channel) have to be provided, of the type already known from known strapping devices. In this, a part of the tape guides is advantageously mounted on the presser arms and is conducted to the strapping position together with the stack held by the presser arms, where it complements stationary tape guiding parts.

Advantageously the strapping is only affixed, when an enveloping material has already been applied around the stack and the presser arms in such a manner, that the strapping is located outside the envelope. This means, that the envelope only has to fulfil a protection function, while the stack stabilising function is taken over by the strapping. In other words, this signifies, that the stack envelope is completely relieved of the conditions mentioned above regarding the elasticity of the enveloping material and/or concerning the compressibility of the stack. For the strapping no such conditions are applicable, because it is not affixed around the presser arms.

The two presser arms receiving a stack and compressing it, for example, have proximal and distal ends aligned to one another, are coupled to a drive with their proximal ends and in the manner of forks comprise at least one slot-shaped opening between two prongs extending towards the distal end and open at the distal end. The tape loop to be applied leads through the forks at the closed ends of the slot-shaped apertures, through the slot-shaped apertures over the outsides of the forks and is closed over the distal ends of the fork. The means for tightening/tensioning, for locking (e.g., welding together) and for cutting off the strapping tape are, for example, located outside one of the forks, whereby if so required to carry out its function it is temporarily moved closer to the stack through the slot-shaped aperture of the fork. The means mentioned, however, can also be located in an area between the two distal ends of the fork.

A stack of printed products is therefore positioned between two forks of a pair of forks assigned to one another, pressed together between them and in the pressed condition conducted to a strapping position for the strapping operation. In an enveloping/wrapping position preceding the strapping position or else in the strapping position itself, additionally a wrapping of the stack can be carried out.

For a multiple strapping operation, forks with more than two prongs and correspondingly multiple tape guides have to be provided.

The method in accordance with the invention and exemplary embodiments of the device according to the invention are described in more detail on the basis of the following Figures:

FIG. 1 schematically illustrates an exemplary embodiment of the strapping device in accordance with the invention in a perspective view;

Figure 7:
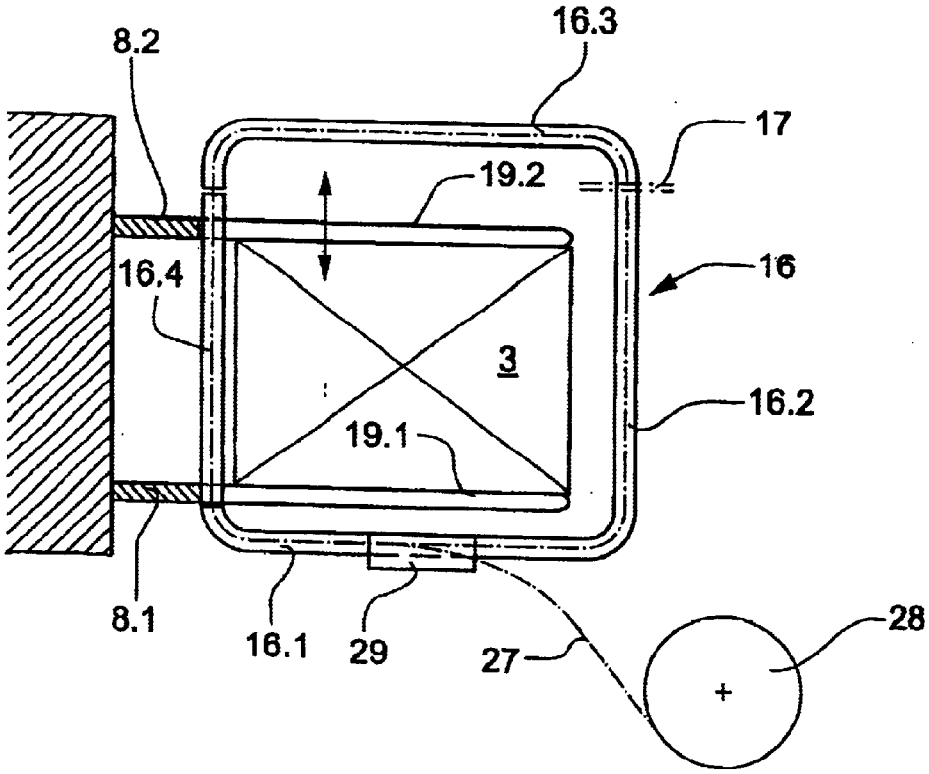
Figure 8:
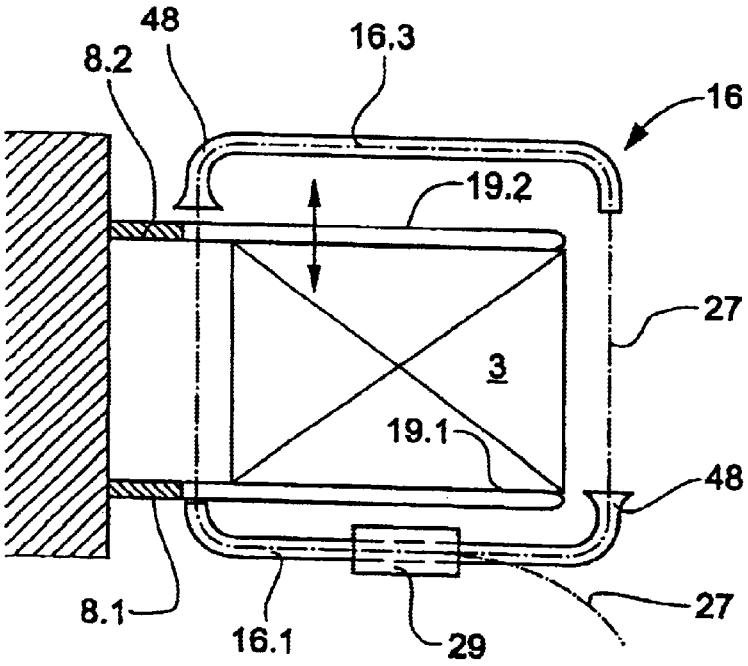
Figure 9:
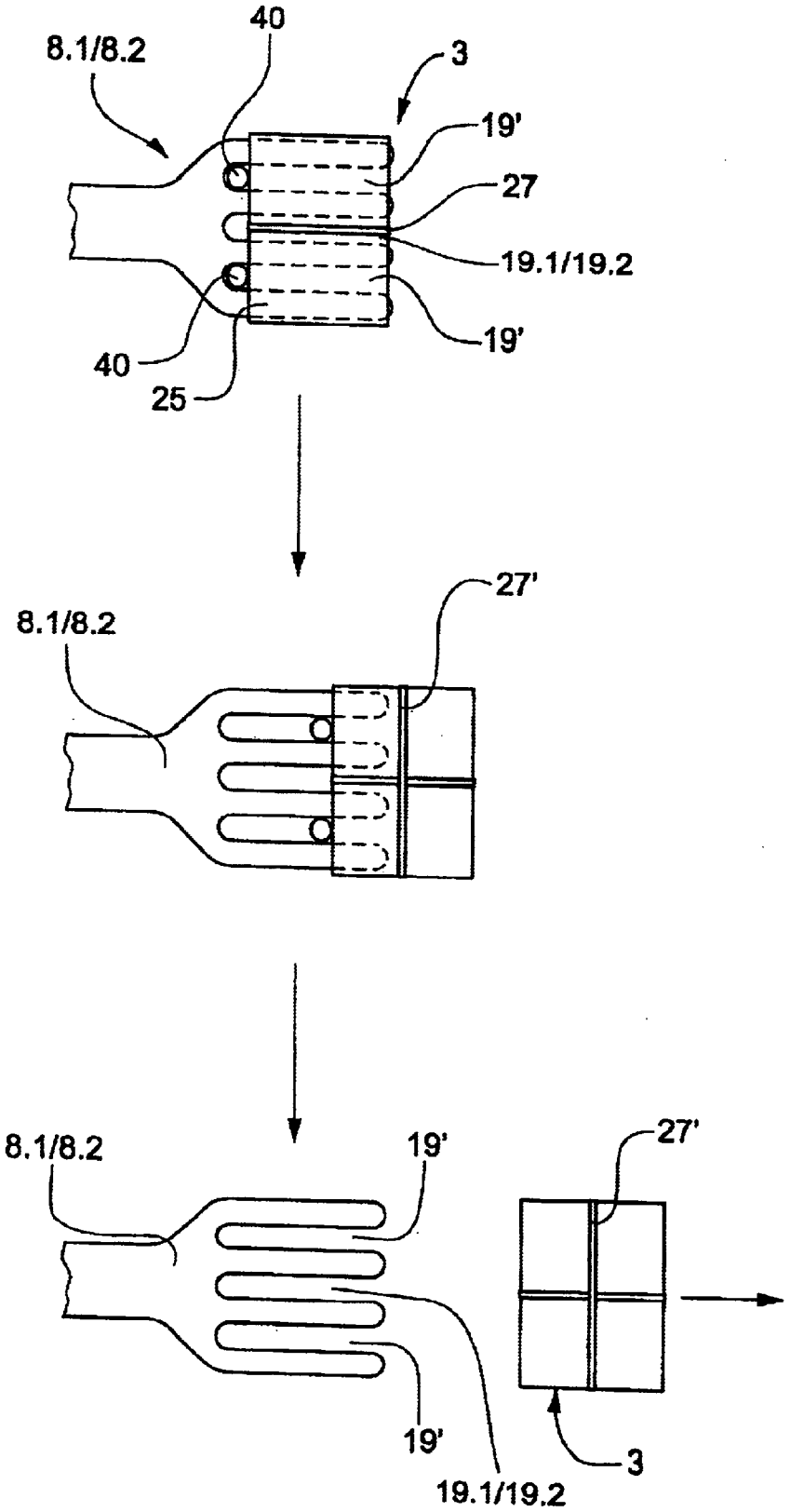

FIGS. 7 and 8 in a section through the strapping position depict different embodiments of tape guiding means;

FIG. 9 illustrates a further strapping of a stack strapped in accordance with the method according to the invention.

Figure 1:
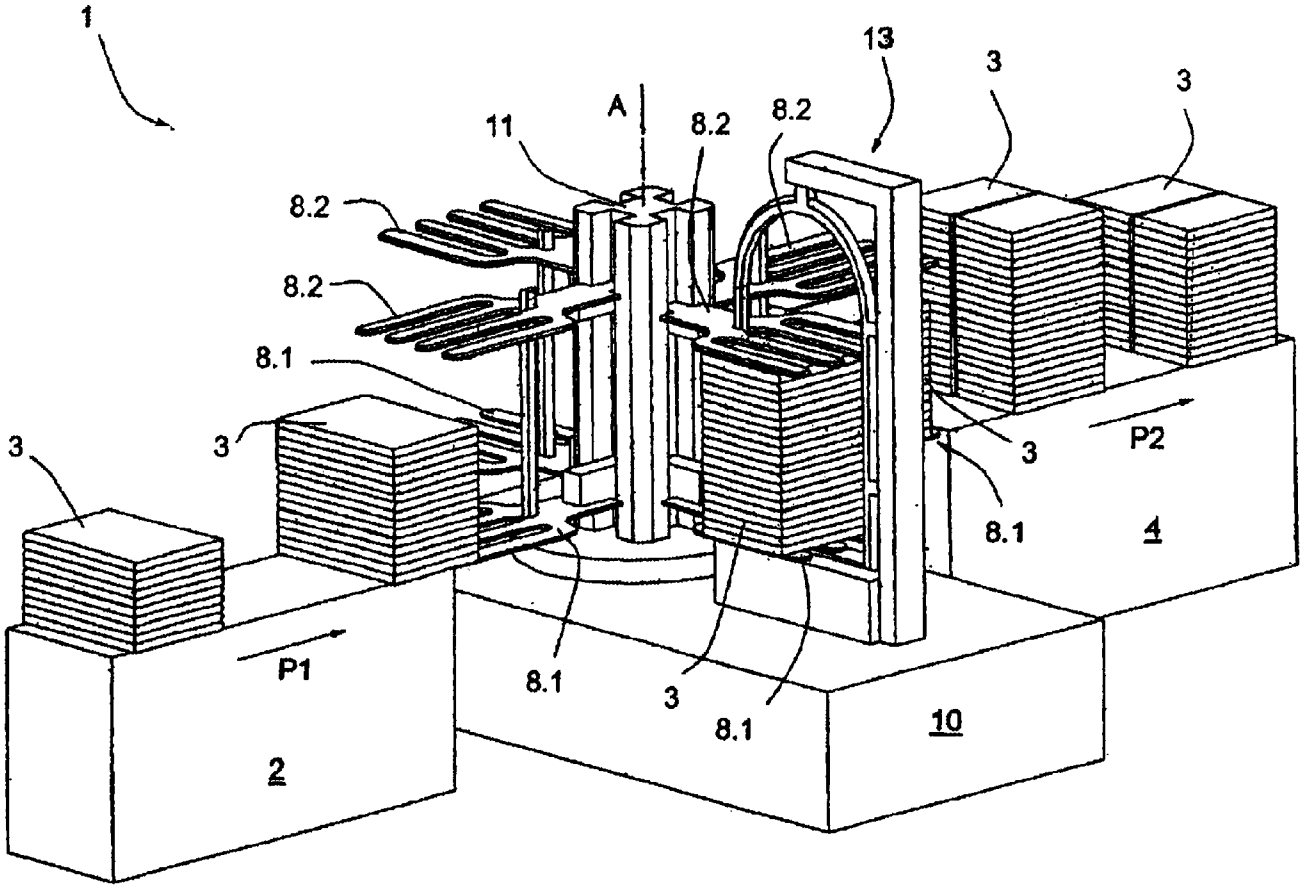

FIG. 1 schematically illustrates an exemplary embodiment of the strapping device 1 in accordance with the invention in a perspective view. Identifiable are a feeding device 2, on which stacks 3 of printed products are conveyed to the strapping device 1 in the direction of an arrow P1. On the other side of the strapping device 1 there is a removal device 4, which serves to remove strapped stacks 3 with, for example, different stack heights, in the direction of an arrow P2. The strapping device comprises a sub-structure 10, a column 111 with, for example, four pairs of forks (respectively 8.1 and 8.2) and a strapping position 13, in which a stack 3 is strapped. The column 11 is arranged vertically to the sub-structure 10 and is rotatable in steps around an axis A and it is moved by a drive, which is integrated into the substructure 10. The fork pairs each comprise a lower fork 8.1 and an upper fork 8.2, which in the zone of their proximal ends are coupled to the column. The upper forks 8.2 for the pressing together of the stacks and for the handling of stacks of different heights are arranged individually movable along the column 11. The pairs of forks and the stacks held pressed together by them are moved in steps around the axis A by the column 11. In the case of other embodiments, the pairs of forks can also be guided, resp., moved in a different way (e.g., in a linear manner by means of link chains).

A stack to be processed is brought by the feeding device 2 between two forks 8.1, 8.2 assigned to one another and held pressed together by lowering the upper fork 8.2. By means of a rotation of the column 11 by, for example 90°, the held stack is then brought into the strapping position 13.

Figure 2:
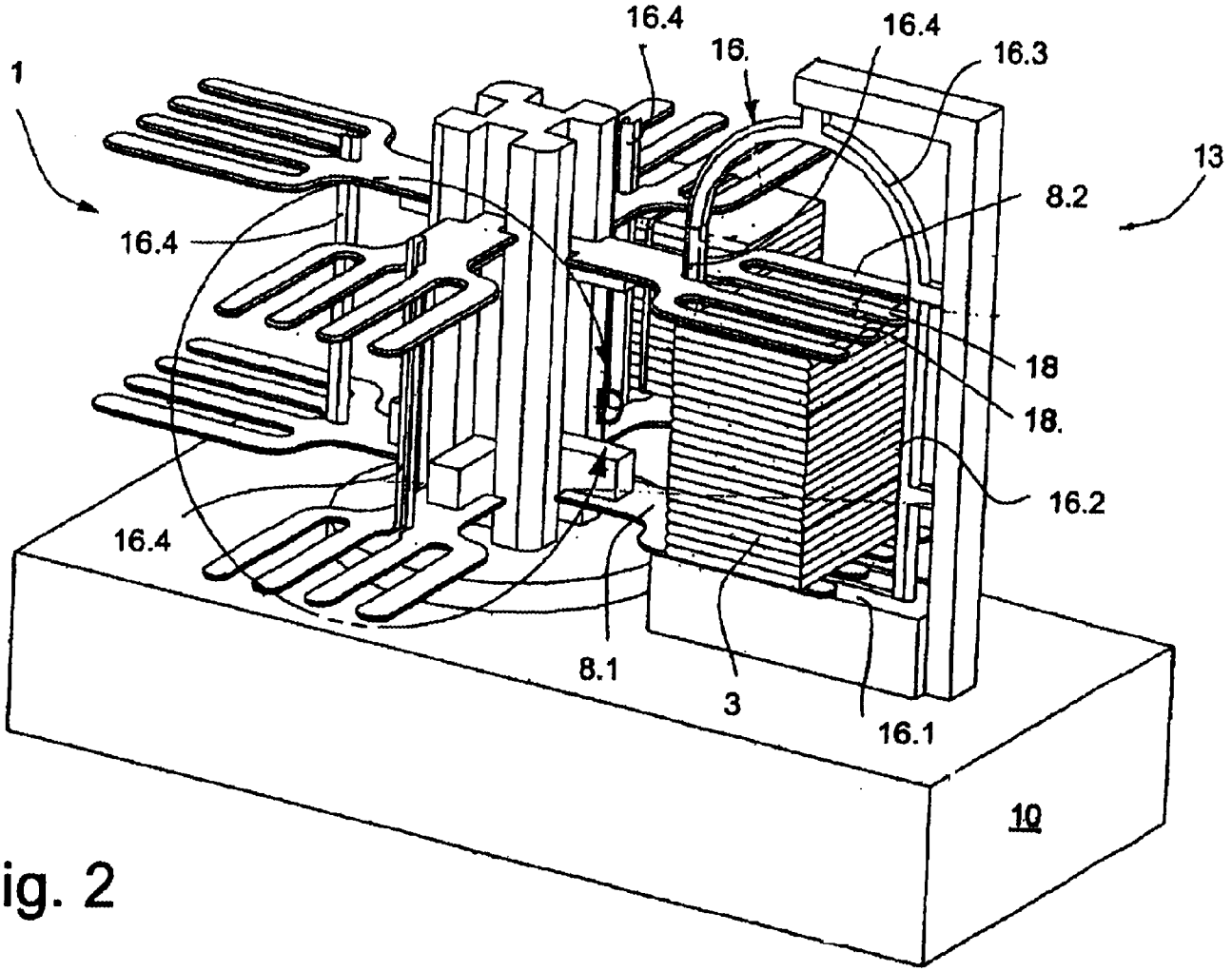
FIG. 2 illustrates a part of the strapping device from FIG. 1 in a perspective view.

FIG. 2 depicts the strapping device 1 from FIG. 1 without the feeding device 2 and the removing device 4 in a perspective view. Identifiable is a stack 3 of printed products, which is held pressed together between two forks 8.1 and 8.2 assigned to one another. The stack 3 during its conveyance to the strapping position 13, during the strapping operation in the strapping position and during its removal from the strapping position is securely held and guided by the two forks 8.1 and 8.2 assigned to one another, whereby very high accelerations are possible.

The tape guide means 16, which serves to establish a tape loop for the strapping operation, is composed of various components, which in part are arranged as stationary in the strapping position 13, in part are movable with the fork pairs. Underneath the position of the lower fork 8.1 and as close as possible to this fork, a stationary, lower channel part 16.1 is located, in which, for example, the means for tensioning, closing and cutting (not illustrated) of the strapping tape are integrated. In the area of the distal fork ends, an also stationary, distal channel part 16.2 is located, which is oriented essentially vertically up to a height, which is greater than the highest position of the upper fork 8.2, and to which an upper, also stationary channel part 16.3 adjoins. The upper channel part 16.3 extends over the upper fork 8.2 towards the proximal end of the pair of forks and there adjoins a further, essentially vertical channel part (proximal channel part 16.4). This proximal channel part 16.4 is fixed to the lower fork 8.1 in such a manner, that it is aligned to the closed end of the slot-shaped aperture of the upper fork 8.2, whereby the upper fork 8.2 is movable upwards and downwards relative to this proximal channel part 16.4. Each of the fork pairs comprises a proximal channel part 16.4.

The tape channel is equipped in a manner known to the specialist in such a way, that it is able to guide the strapping tape for the establishment of the tape loop and that the tape during tightening is essentially able to be pulled out of the channel over the whole channel length and positioned on the stack. As will still have to be demonstrated, parts of the tape channel, in particular the proximal channel part 16.4, can also be missing and the tape through other means can be guided over loop zones without a guide channel. The strapping tape, for example, for enabling self-guidance can be bent in its cross section by means of shaping rollers or shaped in a different way and through this be stiffened, or else it can be guided by air jets aligned in the direction of the tape.

Figure 3:
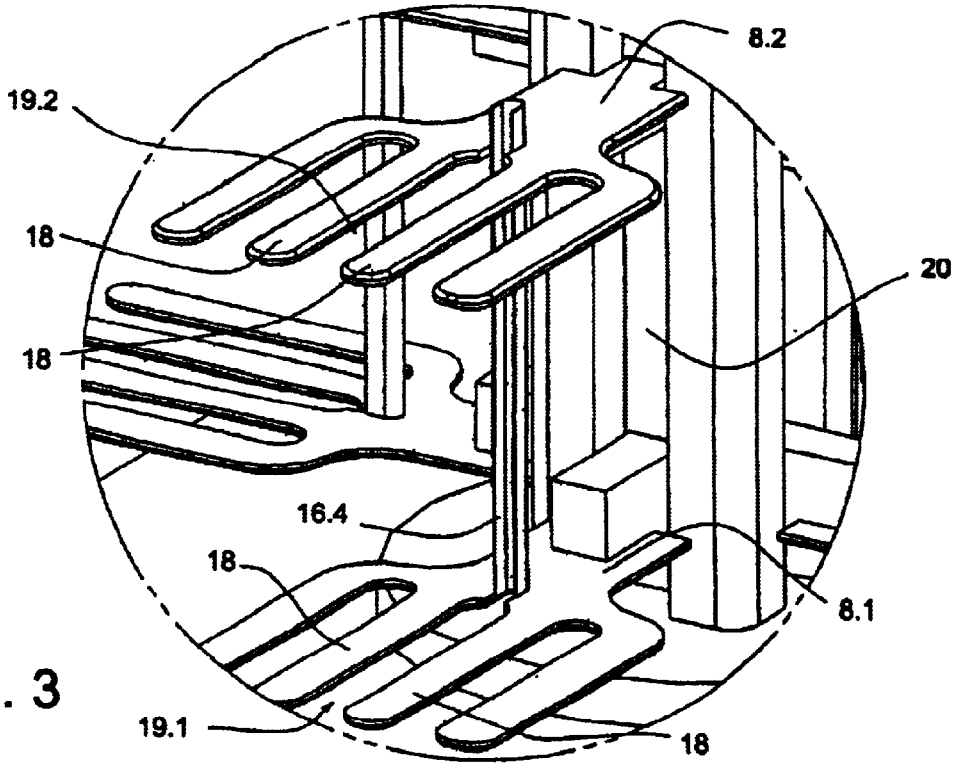
FIG. 3 depicts the presser arms and a part of the tape guides of the strapping device in accordance with FIGS. 1 and 2.

FIG. 3 illustrates a detailed view D from FIG. 2. Identifiable are two forks 8.1 and 8.2 assigned to one another, of which the upper is installed in a linear guide-way 20 on the column 11 and movable upwards and downwards. The proximal channel part 16.4 is rigidly connected with the lower fork 8.1, whereby its opening is aligned to a slot-shaped aperture 19.1 between two prongs 18 of the fork 8.1, in particular to the closed end of this aperture 19.1. The proximal channel part 16.4 if so required continues underneath the lower fork, in order to adjoin the lower channel part 16.1. The proximal channel part 16.4 extends upwards from the lower fork through a slot-shaped aperture 19.2 between two prongs of the upper fork 8.2, which is aligned to the slot-shaped aperture 19.1i right up to above the upper fork (in its highest position), in such a manner, that it can adjoin the upper channel part 16.3 (FIG. 2). The upper fork 8.2 is freely movable upwards and downwards relative to the proximal channel part 16.4.

Figure 4:
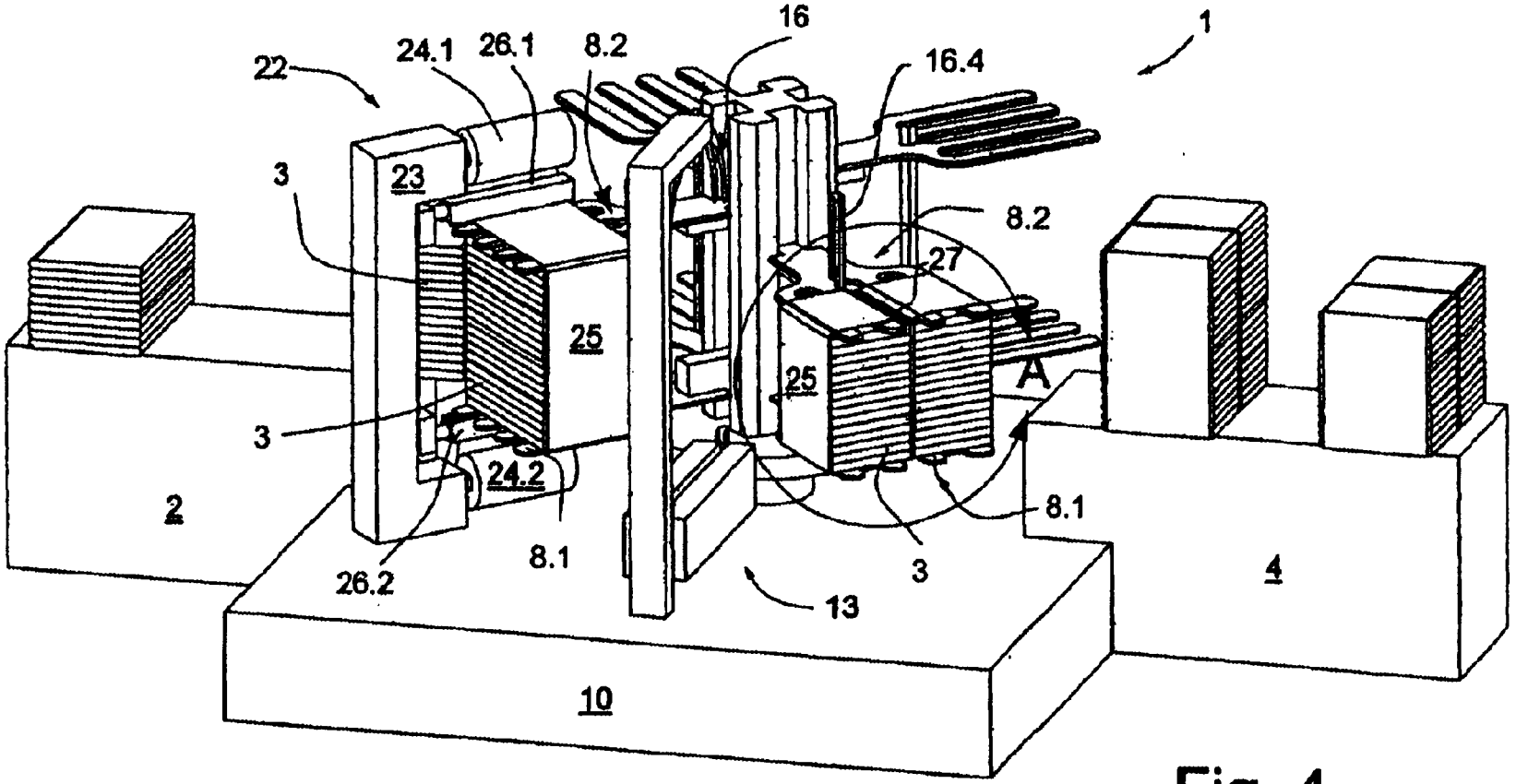
FIG. 4 illustrates a further embodiment of the strapping device in accordance with the invention with an enveloping/wrapping position and a strapping position.

FIG. 4 schematically and in an exemplary fashion illustrates a further strapping device 1 in a perspective view. The strapping device 1 in essence corresponds to the installation depicted in FIG. 1, for which reason the individual elements, which have already been described in association with FIG. 1, are designated with the same reference numbers and are not described anymore. The strapping device 1 illustrated is also equipped as an enveloping/wrapping device, in that it in the direction of movement of the stacks 3 ahead of the strapping position 13 comprises an enveloping/wrapping position 22. In the enveloping/wrapping position 22, for example, the following as such known means serving for wrapping are provided: A roll holder 23 for two rolls 24.1, 24.2 of a wrapping material 25 (e.g., made of polyethylene foil) and means (26.1 and 26.2) for closing and cutting the wrapping material 25 on the trailing side of the stack. The wrapping material 25 between the two rolls 24.1 and 24.2 forms a curtain extending across the path of movement of the stack 3 held by the fork pairs, which is taken along by a passing stack 3, places itself around the stack 3 and forks 8.1 and 8.2 and behind the stack is closed to form an envelope and cut off from the rolls in such a manner, that for the next stack it once again extends across the path of movement in the fashion of a curtain.

After a stack 3 has been wrapped with wrapping material 25 in the enveloping/wrapping position, while still pressed together between the forks it is conducted to the strapping position 13, where, as described above, it is strapped with a strapping tape 27. The enveloped and strapped stack 3 is held pressed together between two forks 8.1, 8.2 assigned to one another and is brought to the removal unit 4 in this manner.

In the strapping position 13, the means already described in connection with the FIGS. 1 and 3 for the establishment of a tape strapping, in particular parts of the tape guide 16, means (not illustrated) for the feeding of the strapping tape 27 from a tape roll and means (not illustrated) for the tensioning, closing and cutting of the strapping tape 27 are arranged. The part of the tape guide 16 arranged as stationary in the strapping position 13 for every strapping operation is complemented to form a loop-shaped guide by means of a proximal channel part 16.4 brought along with the corresponding pair of forks. As soon as a pair of forks with the proximal channel part 16.4 is correspondingly positioned, the strapping tape 27 is introduced into the channel, so that it forms a loop around the stack. For the introduction of the tape, in addition to the supply roll, for example, a tape store and a tape feed device have to be provided, which, for example, are incorporated in the sub-structure 10.

Figure 5:
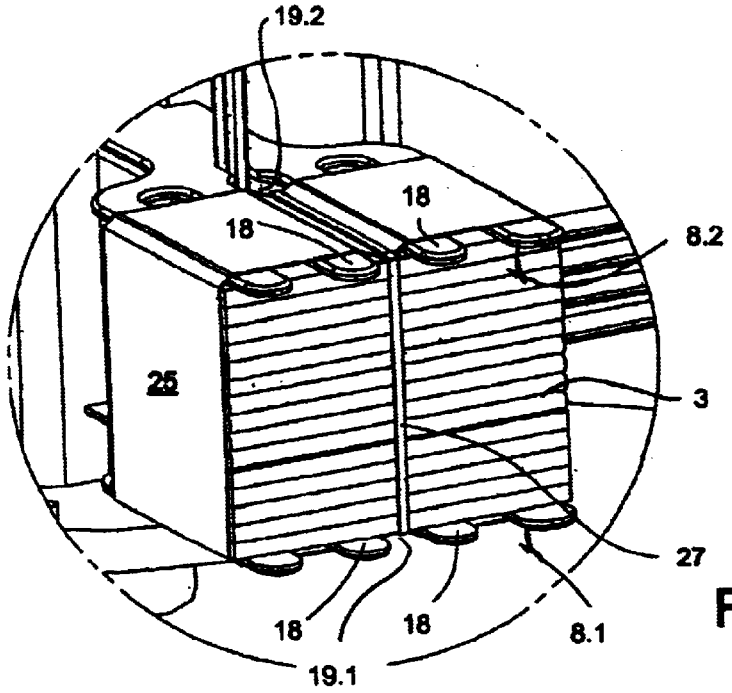
FIG. 5 depicts a stack enveloped and strapped in the device according to FIG. 4 immediately after the strapping operation.

FIG. 5 depicts an enlarged section from FIG. 4. Identifiable is a stack 3 held pressed together between two forks 8.land 8.2 assigned to one another, which has been strapped with a strapping tape 27 and before this has been enveloped with a wrapping material 25. As can be seen, the strapping tape is positioned tightly against the stack 3 in slot-shaped apertures between the prongs 18 of the forks 8.1 and 8.2, while the enveloping material also envelops the forks. For a removal of the enveloped and strapped stack from the forks 8.1 and 8.2, for example, pins are introduced between the proximal ends of the prongs 18 in such a manner, that they rise above both forks, and then are moved towards the proximal ends of the prongs, whereby they slide the enveloped and strapped stack off the forks.

Figure 6:
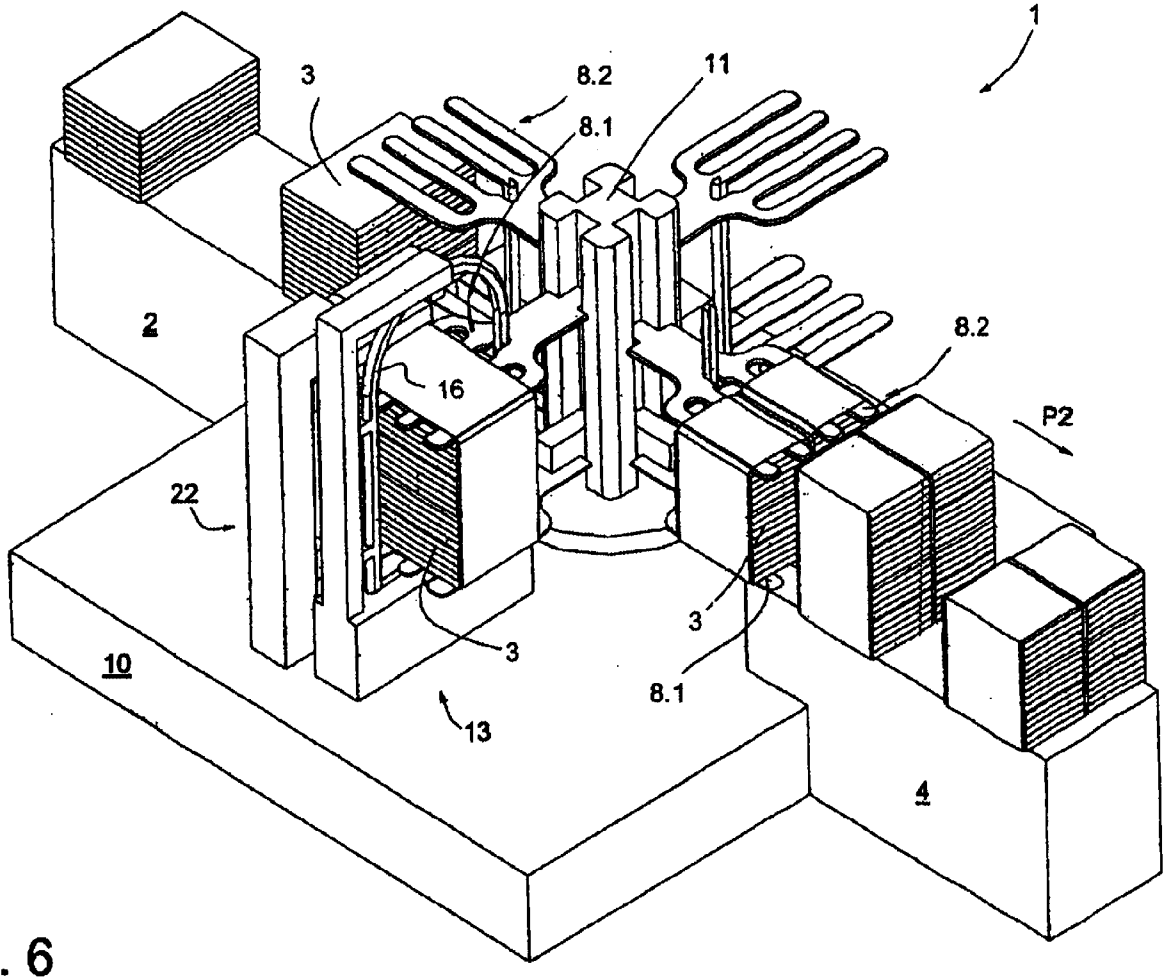
FIG. 6 illustrates a further embodiment of the strapping device in accordance with the invention with a strapping position, which at the same time serves as enveloping/wrapping position.

FIG. 6 illustrates a further preferred embodiment of the strapping device 1 in accordance with the invention in a perspective view. The strapping device 1 essentially corresponds to the device depicted in FIG. 4, for which reason the already described elements are not described anymore here. In this embodiment, the enveloping/wrapping position 22 and the strapping position 13 are identical, in such a manner, that a stack 3 in essence can be simultaneously enveloped and strapped. At the same time as the enveloping/strapping of a stack, a stack 3 to be strapped is taken hold of by a pair of forks 8.1, 8.2 in a loading position in the zone of the feeding device 2 and an enveloped and strapped stack 3 in a discharge position in the zone of the removal device 4 is pushed by a pair of forks and taken away.

FIGS. 7 and 8 depict exemplary embodiments of the tape guide 16, which is to be provided in the strapping position 13 of the strapping device in accordance with the invention for the establishment of a tape loop. The Figures are cross sections along the slot-shaped apertures 19.1 and 19.2 of a pair of forks (8.1, 8.2), which is holding a stack 3 pressed together. The Figures in the tape guide 16 also depict a tape loop of the strapping tape 27 (as a dot-dash line), a supply roll 28, from which the strapping tape is drawn, as well as schematically simplified as a box 29 the means for the feeding of the strapping tape 27 to the tape guide 16 and the means for tightening/tensioning, locking and cutting the strapping tape 27.

The embodiment in accordance with FIG. 7 is essentially the same one as illustrated in the FIGS. 1 to 6, with a tape channel completely predefining the tape loop consisting of a stationary lower, distal and upper channel part (16.1, 16.2 and 16.3) and with a proximal channel part 16.4 moved into the strapping position with the pair of forks 8.1 and 8.2, which continues through the closed ends of the slot-shaped apertures 19.1 and 19.2 in the forks 8.1 and 8.2. In a device, in which the stacks 3 are only strapped and not enveloped, the upper channel part 16.3 can also be moved along together with the forks 8.1 and 8.2, so that the border between the stationary channel part and the moving channel part is situated at the point indicated as 17. For this case, the upper channel part can also be integrated into the upper presser arm 8.2.

FIG. 8 illustrates an embodiment of tape guides 16, in which only above and underneath the forks 8.1 and 8.2 a channel part (lower and upper channel part 16.1 and 16.3) is provided, while the distal and proximal channel parts are missing. For an establishment of the tape loop without any problems, for the zones without a tape channel other means of guidance have to be provided. These are at least collecting funnels 18 at the ends catching the tape ends of the existing channel parts and/or nozzles for the generation of air jets, which guide the strapping tape through those zones without channels. As already mentioned further above, the strapping tape also can be made more rigid by means of a corresponding shaping, in order for it to be able to be moved without any problems through the zones without any guides.

The embodiment in accordance with FIG. 8 has the advantage, that in the strapping position both the distal as well as the proximal side of the stack remain accessible, for example, for means, with which parts of the envelope protruding beyond the sides of the stack can be pulled over these sides and closed around the stack.

In all FIGS. 1 to 8, the two presser arms, resp., presser forks 8.1 and 8.2 take hold of the stack from below and above and the upper presser arm for the pressing together of a stack and for its release is moved towards the lower presser arm and away from it (upwards and downwards), while the lower presser arm has a height, which does not vary. All this, however, does not represent a condition for the invention. While the presser arms always press the stack together from its face sides, these, however, can have any position within space. The presser arms are movable relative to one another. In this, it is advantageous to position one of the presser arms in the strapping position always in the same position and in particular to arrange the means for tightening/tensioning, locking and cutting of the strapping tape on the outside of the presser arm positioned in this manner in such a way, as is the case in the FIGS. 7 and 8.

FIG. 9 illustrates, how the method in accordance with the invention for the purpose of establishing a cross-strapping around a stack held between presser arms, which if so required is also enveloped/wrapped, can advantageously be complemented. The stack 3, as it is depicted on top in FIG. 9, as already described is held pressed together by presser arms 8.1 and 8.2, is wrapped with an enveloping material 25 and strapped with a strapping tape 27, whereby the envelope includes the presser arms and the strapping is located above the envelope, is oriented transverse to the envelope and runs in slot-shaped apertures 9.1 and 19.2 of the presser arms 8.1 and 8.2. This stack with its envelope and strapping is now slid off the presser arms by means of pins 40, which are introduced into closed ends of further slot-shaped apertures 19' and moved towards the distal end of the presser arms. In doing so, the stack at first is only slid about halfway off the presser arms and in this manner positioned in a further strapping position. In this position, in an as such known manner it is strapped transverse to the ejection direction with another strapping tape 27'. When the strapping 27' has been carried out, the ejection pins 40 are moved on and the stack 3 is slid completely off the presser arms.

In a strapping position without a distal tape channel part, as it is illustrated in FIG. 8, the second strapping can be carried out with an unchanged position of the pair of forks. Advantageously, however, it is established in a further ejection position, which follows the strapping position.

It is also conceivable to replace the envelope described in connection with the FIGS. 4 to 6, which has been established in the strapping position 13, by a first strapping. This is carried out in the strapping position 13 or in a preceding, further strapping position, whereby the strapping device in essence runs transverse to the connection between the distal and proximal end of the presser arms. The tape guide for a strapping of this type advantageously on the outside of the lower presser arm is provided with a stationary channel part aligned to a corresponding aperture in the presser arm and a channel part integrated into the upper presser arm.

What is claimed is:

1. A method of sequentially strapping stacks of printed products comprising:

conveying the stacks one after another in a conveying direction to a strapping device having a loading position, a strapping position and a discharge position;

pressing one of the stacks between a pair of presser arms that extend in a direction opposite the conveying direction while the stack is in the loading position, the presser arms having distal and proximal ends that are aligned to one another, the proximal ends being coupled to a drive and the distal ends comprising forks having at least two prongs that cooperate to define at least one slot-shaped aperture;

rotating the stack while the stack is pressed between the presser arms to the strapping position wherein each presser arm extends in a direction perpendicular to the conveying direction;

placing a loop of strapping tape around the stack and through the slot-shaped apertures while the stack is in the strapping position, wherein the loop of strapping tape is laid out in a plane that is oriented parallel to the connection between the proximal ends of the presser arms and the drive, and wherein the strapping tape passes through a tape guide that moves with the presser arms and stack from the loading position to the strapping position;

tightening and locking the strapping tape around the stack while in the strapping position, the strapping tape being pulled through the slot-shaped apertures toward the stack during tightening; and rotating the strapped stack to the discharge position.

2. The method in accordance with claim 1, wherein prior to the strapping, the stack is enveloped with an enveloping material that is applied around the presser arms and the stack, the enveloping material being applied around the stack in a direction that is perpendicular to the loop of strapping tape.

3. The method in accordance with claim 2, wherein the presser arms and the stack are moved together through a curtain of enveloping material to apply the enveloping material.

4. The method in accordance with claim 3, wherein the enveloping material during the strapping is closed around the presser arms and the stack.

5. The method in accordance with claim 2, wherein the enveloped and strapped stack is separated from the presser arms by relative movement between the presser arms and stack.

6. The method in accordance with claim 5, wherein the enveloped and strapped stack is partially separated from the presser arms, and then is additionally strapped transverse to the direction of the relative movement and thereupon is completely separated from the presser arms.

7. A device for sequentially strapping stacks of printed products with two face sides located opposite one another, said device having a loading position, a strapping position and a discharge position, the device comprising a tape guide comprising a channel for establishing a tape loop around a stack positioned in the strapping position and means for feeding a strapping tape into the tape guide and for tightening, tensioning, locking and cutting the strapping tape, means for feeding-in stacks to the strapping position and for removing stacks from the strapping position, wherein the means for feeding-in and for removing stacks comprise pairs of presser arms movable towards one another in which stacks are pressed together between their face sides, said presser arms each comprising at least one slot-shaped aperture, and wherein the tape guide is aligned with and connected to the slot-shaped apertures of the presser arms and thus moves with the presser arms when the presser arms are rotated from the loading position to the strapping position.

8. The device in accordance with claim 7, wherein the presser arms comprise distal and proximal ends aligned to one another whereby, at their proximal ends, they are coupled to a drive and, at their distal ends, they are shaped as forks having at least two prongs that define at least one slot-shaped aperture between said at least two prongs.

9. The device in accordance with claim 8, further comprising means for enveloping/wrapping stacks with an enveloping material.

10. The device in accordance with claim 9, wherein the enveloping/wrapping means are arranged in the loading position preceding the strapping position or in the strapping position.

11. The device in accordance with claim 9, wherein the enveloping/wrapping means comprise means for establishing a curtain of the enveloping material extending across the feeding path of the presser arms and stack up to the strapping position.

12. The device in accordance with claim 8, further comprising means for further strapping the stacks when a stack held pressed together by the presser arms has been slid half-way over the distal end of the presser arms, the further strapping being transverse to the direction of sliding.

* * * * *

UNITED STATES PATENT AND TRADEMARK OFFICE

CERTIFICATE OF CORRECTION

PATENT NO. : 6,619,014 B2
DATED : September 16, 2003
INVENTOR(S) : Muller

It is certified that error appears in the above-identified patent and that said Letters Patent is hereby corrected as shown below:

Title page,
Item [56], References Cited, U.S. PATENT DOCUMENTS, insert
-- 6,070,395 06/2000 Calvano, Furruccio Carmelo…….53/451 -- and
-- 5,284,003 02/1994 Goodman et al…….53/437 --.

Column 8,
Line 44, delete Claim 8 in its entirety.
Line 50, delete "claim 8" and insert -- claim 7 --.
Line 61, delete "claim 8" and insert -- claim 7 --.
Line 66, add the following new claims -- 13. The method according to claim 1, wherein the strapping tape passes through a tape guide, and at least a part of the tape guide moves into the strapping position with the presser arms and stack.

14. The device in accordance with claim 7, wherein the tape guide (16) comprises tape channel parts.

15. The device in accordance with claim 14, wherein the tape guide (16), in addition to the tape channel parts (16.1, 16.3), comprises means for shaping the cross-section of the strapping tape (27) or means for generating air jets, which guide the stapping tape (27).

16. The device in accordance with claim 14, wherein at least one tape channel part (16.4) is connected with the presser arms (8.1 and 8.2) and is positioned in the strapping position (13) with the presser arms (8.1 and 8.2.). --

Signed and Sealed this

Second Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,619,014 B2
DATED : September 16, 2003
INVENTOR(S) : Muller

It is certified that error appears in the above-identified patent and that said Letters Patent is hereby corrected as shown below:

Column 7,
Line 40, delete claim 1 in its entirety and insert the following revised claim
-- 1. A method for sequentially strapping stacks of printed products comprising:
conveying the stacks one after another to a strapping position and then conveying strapped stacks away from the strapping position; during conveying and strapping, pressing the stacks between a pair of presser arms, the presser arms having distal and proximal ends that are aligned with one another in a length direction, the proximal ends being coupled to a drive and the distal ends comprising forks having at least two prongs that cooperate to define at least one slot-shaped aperture, said presser arms being moved toward and away from the strapping position in a direction that is generally transverse to the length direction of the presser arms;
placing a loop of strapping tape around the stack and through the slot-shaped apertures while the stack is in the strapping position, wherein the loop of strapping tape is laid out in a plane that is oriented parallel to the length direction;
tightening and locking the strapping tape around the stack while in the strapping position, the strapping tape being pulled through the slot-shaped apertures toward the stack during tightening. --.

Column 8,
Line 26, delete claim 7 in its entirety and insert the following revised claim
-- 7. A device for sequentially strapping stacks of printed products with two face sides located opposite on another, said device having a strapping position and comprising a tape guide for establishing a tape loop around a stack positioned in the strapping position, means for feeding a strapping tape into the tape guide and for tightening, tensioning, locking and cutting the strapping tape, and means for feeding-in stacks to the strapping position and for removing stacks from the strapping position, wherein the means for feeding-in and for removing stacks comprise pairs of presser arms, said presser arms having a length directions and being movable towards one another transverse to said length direction so as to press the stacks together netween their face sides, each of said presser arms comprising distal and proximal ends aligned with one another whereby , at their proximal ends, they are coupled to a drive and, at their distal ends, they are shaped as forks having at least two prongs that defne at least one slot-shaped aperture between said at least two prongs,

UNITED STATES PATENT AND TRADEMARK OFFICE

CERTIFICATE OF CORRECTION

PATENT NO. : 6,619,014 B2
DATED : September 16, 2003
INVENTOR(S) : Muller

It is certified that error appears in the above-identified patent and that said Letters Patent is hereby corrected as shown below:

Column 8, (to be cont.),
and wherein the tape guide is disposed outside of said presser arms while being aligned with the slot-shaped apertures so as to pass the tape loop through the slot-shaped aperture and in a plane extending generally parallel to said length direction. --

Signed and Sealed this

Tenth Day of August, 2004

JON W. DUDAS
*Acting Director of the United States Patent and Trademark Office*